US011053933B2

(12) United States Patent
Warren et al.

(10) Patent No.: US 11,053,933 B2
(45) Date of Patent: Jul. 6, 2021

(54) DISPLACEMENT CONTROL VALVE

(71) Applicants: EAGLE INDUSTRY CO., LTD., Tokyo (JP); MAHLE INTERNATIONAL GMBH, Stuttgart (DE)

(72) Inventors: Matthew R. Warren, Buffalo, NY (US); Ernesto Jose Gutierrez, Amherst, NY (US); Daichi Kurihara, Tokyo (JP); Takahiro Ejima, Tokyo (JP); Wataru Takahashi, Tokyo (JP); Kohei Fukudome, Tokyo (JP); Masahiro Hayama, Tokyo (JP); Yoshihiro Ogawa, Tokyo (JP); Keigo Shirafuji, Tokyo (JP)

(73) Assignees: EAGLE INDUSTRY CO., LTD.; MAHLE INTERNATIONAL GMBH

( * ) Notice: Subject to any disclaimer, the term of this patent is extended or adjusted under 35 U.S.C. 154(b) by 96 days.

(21) Appl. No.: 16/219,570

(22) Filed: Dec. 13, 2018

(65) Prior Publication Data

US 2020/0191139 A1 Jun. 18, 2020

(51) Int. Cl.

| | |
|---|---|
| ***F04B 49/22*** | (2006.01) |
| ***F04B 27/18*** | (2006.01) |
| ***F25B 49/02*** | (2006.01) |

(52) U.S. Cl.

CPC ..... *F04B 49/22* (2013.01); *F04B 27/1804* (2013.01); *F25B 49/022* (2013.01); *F04B 2027/1831* (2013.01); *F04B 2027/1854* (2013.01); *F04B 2027/1877* (2013.01)

(58) Field of Classification Search

CPC ..... F04B 49/22; F04B 27/18; F04B 27/1804; F04B 2027/1854; F04B 2027/1877; F04B 2027/1831; B60H 1/3205; B60H 1/3216; B60H 2001/327

See application file for complete search history.

(56) References Cited

U.S. PATENT DOCUMENTS

| | | | | |
|---|---|---|---|---|
| 8,079,827 | B2 | 12/2011 | Iwa et al. | 417/222.2 |
| 2012/0198992 | A1 * | 8/2012 | Futakuchi | F04B 27/1804 91/505 |
| 2017/0363074 | A1 * | 12/2017 | Taguchi | F04B 27/1081 |

FOREIGN PATENT DOCUMENTS

| | | | |
|---|---|---|---|
| JP | 5167121 | 3/2013 | F04B 27/14 |
| WO | WO-2011065693 A2 * | 6/2011 | F16K 31/0634 |

OTHER PUBLICATIONS

WO2011065693 translation (Year: 2020).*

* cited by examiner

*Primary Examiner* — Devon C Kramer
*Assistant Examiner* — David N Brandt
(74) *Attorney, Agent, or Firm* — Hayes Soloway P.C.

(57) ABSTRACT

Provided is A displacement control valve which includes a valve housing, a valve element constituting a main valve that contacts and separates from a main valve seat, for opening and closing communication between discharge ports and control ports by driving force of a solenoid, a pressure-sensitive valve that opens and closes according to ambient pressure, and a pressure-sensitive valve member constituting the pressure-sensitive valve together with a pressure-sensitive element. The valve element and the pressure-sensitive valve member are formed with an intermediate communicating passage which allows communication between the control ports and the suction ports by opening and closing of the pressure-sensitive valve.

17 Claims, 6 Drawing Sheets

DISPLACEMENT CONTROL VALVE

TECHNICAL FIELD

The present invention relates to displacement control valves for variably controlling the displacement or pressure of working fluid, and for example, relates to a displacement control valve for controlling the discharge rate of a variable displacement compressor used in an automobile air-conditioning system, according to pressure.

BACKGROUND ART

A variable displacement compressor used in an air-conditioning system of an automobile or the like includes a rotating shaft rotationally driven by an engine, a swash plate connected to the rotating shaft at a variable inclination angle, and compression pistons connected to the swash plate. By changing the inclination angle of the swash plate, the variable displacement compressor changes the stroke volume of the pistons to control the fluid discharge rate. Using a displacement control valve that is driven by electromagnetic force to open and close, the inclination angle of the swash plate can be changed continuously by properly controlling pressure in a control chamber while utilizing suction pressure Ps in a suction chamber for sucking fluid, discharge pressure Pd in a discharge chamber for discharging fluid pressurized by the pistons, and control pressure Pc in the control chamber housing the swash plate (see Patent Citation 1).

During continuous driving of the variable displacement compressor (hereinafter, sometimes referred to simply as "during continuous driving"), the displacement control valve, the energization of which is controlled by a control computer, performs normal control of adjusting the control pressure Pc by moving a valve element axially by electromagnetic force generated by a solenoid, opening and closing a main valve, and supplying pressure in the discharge chamber to the control chamber.

During the normal control of the displacement control valve, the pressure in the control chamber in the variable displacement compressor is controlled properly. By continuously changing the inclination angle of the swash plate with respect to the rotating shaft, the stroke volume of the pistons is changed to control the discharge rate of fluid into the discharge chamber to adjust the air-conditioning system to have a desired cooling capacity. When the variable displacement compressor is driven at a maximum capacity, the main valve of the displacement control valve is closed to reduce the pressure in the control chamber, thereby to maximize the inclination angle of the swash plate.

There is known another one that forms an auxiliary communicating passage that allows communication between control ports and suction ports of a displacement control valve so that, at the time of startup, a refrigerant in a control chamber of a variable displacement compressor is discharged through the control ports, the auxiliary communicating passage, and the suction ports into a suction chamber of the variable displacement compressor to quickly reduce the pressure in the control chamber at the time of startup, and thereby to improve the responsivity of the variable displacement compressor (Patent Citation 1).

CITATION LIST

Patent Literature

Patent Citation 1: JP 5167121 B2 (page 7, FIG. 2)

SUMMARY OF INVENTION

Technical Problem

In Patent Citation 1, the fluid discharge function is excellent at the time of startup. However, during the continuous driving of the variable displacement compressor, the refrigerant flows from the control ports into the suction ports since the auxiliary communicating passage connects the ports, increasing the refrigerant flow. This can lead to a reduction in the operational efficiency of the variable displacement compressor.

The present invention has been made with attention focused on this problem, and has an object of providing a displacement control valve having a good operational efficiency while having a fluid discharge function at the time of startup.

Solution to Problem

In order to solve the foregoing problem, a displacement control valve according to a first aspect of the present invention includes a valve housing formed with a discharge port, a suction port, and a control port, a valve element constituting a main valve that contacts and separates from a main valve seat, for opening and closing communication between the discharge port and the control port by driving force of a solenoid, a pressure-sensitive valve that opens and closes according to ambient pressure, and a pressure-sensitive valve member extending from the valve element to a pressure-sensitive chamber, and constituting the pressure-sensitive valve together with a pressure-sensitive element, the valve element and the pressure-sensitive valve member being formed with an intermediate communicating passage, the intermediate communicating passage allowing communication between the control port and the suction port by opening and closing of the pressure-sensitive valve, in which the pressure-sensitive valve member is formed with a through hole communicating with the intermediate communicating passage, and is provided with a sliding member that slides relatively to the pressure-sensitive valve member by fluid flow produced by opening of the main valve, for opening and closing the through hole.

According to the first aspect, when the main valve is closed at the time of startup and in a maximum energized state, the sliding member is opened to connect the control port and the suction port, so that control pressure can be quickly reduced. On the other hand, when the main valve is controlled in an energized state, the sliding member is closed to cut off connection between the control port and the suction port, so that fluid flow from the control port into the suction port can be prevented. Thus, the variable displacement compressor can be enhanced in the discharge of a liquid refrigerant at the time of startup and operational efficiency.

According to a second aspect of the present invention, the sliding member is preferably formed with a receiving surface facing toward the main valve.

According to the second aspect, the sliding member operates easily by fluid flow produced by the opening of the main valve.

According to a third aspect of the present invention, the receiving surface is preferably inclined with respect to a reciprocating direction of the valve element.

According to the third aspect, fluid easily flows from the discharge port toward the control port by the opening of the main valve.

According to a fourth aspect of the present invention, on a back side of the receiving surface, a biasing member for biasing the sliding member toward the main valve side is preferably disposed.

According to the fourth aspect, the sliding member can be moved by a simple structure.

According to a fifth aspect of the present invention, the sliding member is preferably formed with a vent hole on the main valve side of the opening/closing end portion.

According to the fifth aspect, fluid in a space formed between the sliding member and the pressure-sensitive valve member is allowed to flow in and out, and is less prone to develop a pressure difference between the interior of the space and the pressure-sensitive chamber, so that the sliding member can slide smoothly.

According to a sixth aspect of the present invention, the sliding member is preferably disposed so that the sliding member can move while closing the through hole.

According to the sixth aspect, since the through hole is closed until the sliding member has slid a predetermined distance or more, even when the sliding member is slightly slid by disturbance such as vibration, the through hole can be maintained closed. The displacement control valve is thus resistant to disturbance and excellent in control accuracy.

According to an seventh aspect of the present invention, the valve element and the pressure-sensitive valve member are preferably different bodies, and the valve element is preferably formed with a stopper for restricting movement of the sliding member to the valve element side.

According to the seventh aspect, the sliding of the sliding member can be restricted by a simple structure.

According to a eighth aspect of the present invention, the through hole is preferably one of a plurality of through holes formed in the pressure-sensitive valve member.

According to the eighth aspect, a large flow path cross-sectional area can be provided.

DESCRIPTION OF EMBODIMENTS

A mode for carrying out a displacement control valve according to the present invention will be described below based on embodiments.

First Embodiment

Figure 1:
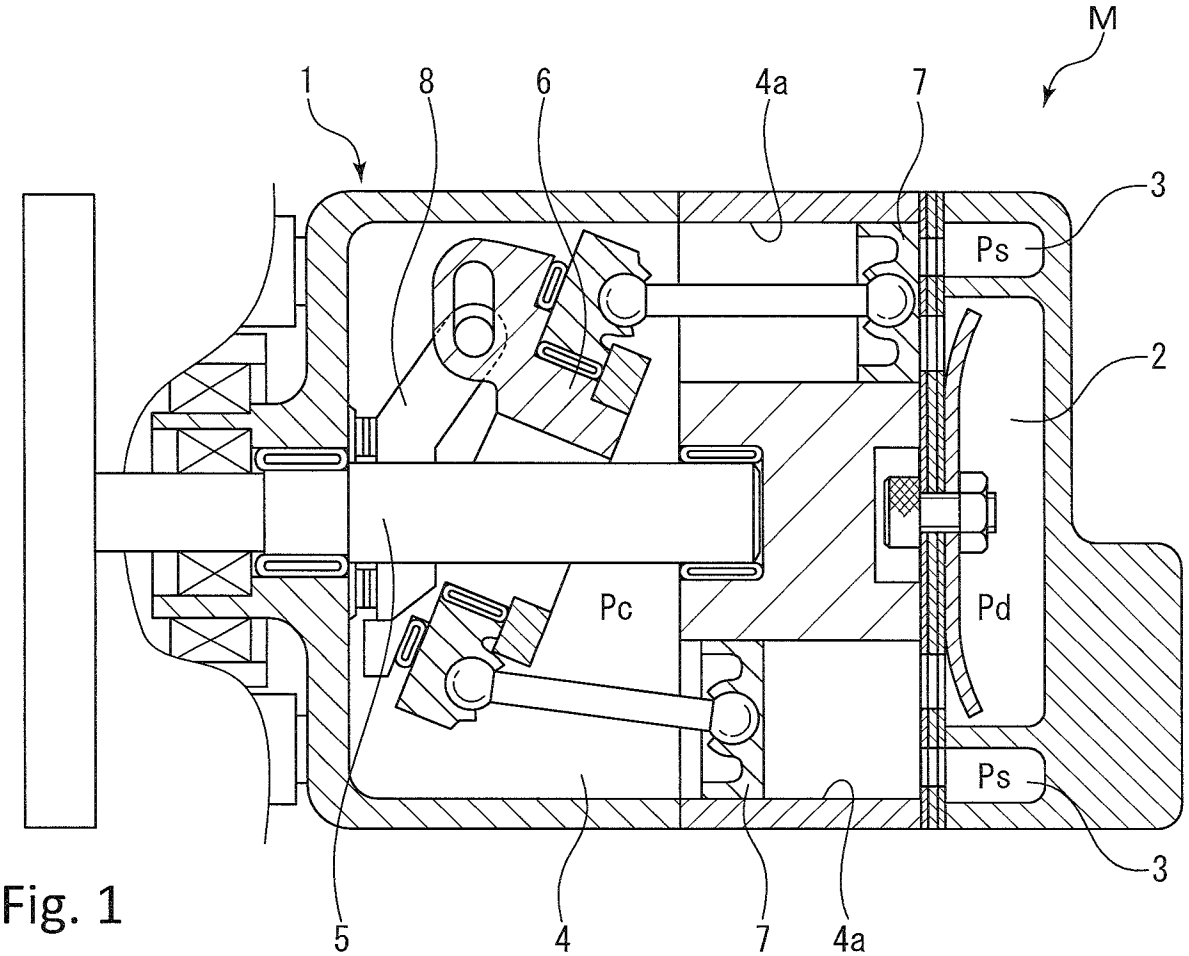
FIG. 1 is a schematic configuration diagram showing a swash plate variable displacement compressor incorporated with a displacement control valve according to a first embodiment of the present invention.
Figure 2:
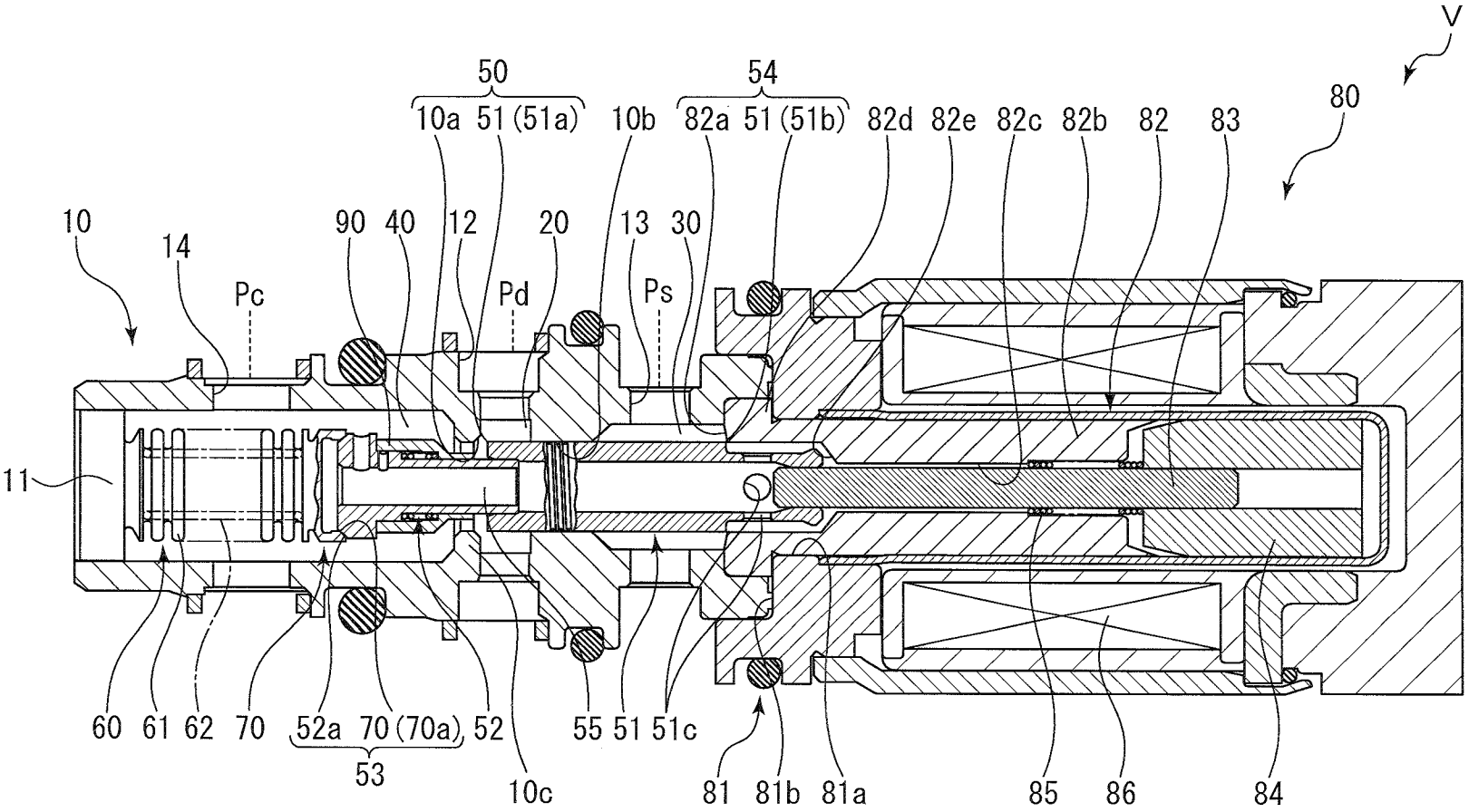
FIG. 2 is a cross-sectional view showing the displacement control valve in the first embodiment in a non-energized state in which a main valve is opened, and through holes in a pressure-sensitive valve member are closed by the movement of a sliding member.

A displacement control valve according to a first embodiment will be described with reference to FIGS. 1 to 5. In the following description, the right and left sides as viewed from the front side in FIG. 2 are referred to as the right and left sides of the displacement control valve.

A displacement control valve V of the present invention is incorporated in a variable displacement compressor M used in an air-conditioning system of an automobile or the like, and variably controls the pressure of working fluid as a refrigerant (hereinafter, referred to simply as "fluid"), thereby to control the discharge rate of the variable displacement compressor M to adjust the air-conditioning system to have a desired cooling capacity.

First, the variable displacement compressor M will be described. As shown in FIG. 1, the variable displacement compressor M has a casing 1 that includes a discharge chamber 2, a suction chamber 3, a control chamber 4, and a plurality of cylinders 4*a*. The variable displacement compressor M is provided with a communicating passage not shown that directly connects the control chamber 4 and the suction chamber 3. The communicating passage is provided with a fixed orifice for adjusting the pressure balance between the suction chamber 3 and the control chamber 4.

The variable displacement compressor M includes a rotating shaft 5 rotationally driven by an engine not shown installed outside the casing 1, a swash plate 6 connected to the rotating shaft 5 in an eccentric state by a hinge mechanism 8 in the control chamber 4, and a plurality of pistons 7 connected to the swash plate 6 and fitted reciprocatably in the respective cylinders 4*a*. Using the displacement control valve V that is driven by electromagnetic force to open and close, the variable displacement compressor M controls the fluid discharge rate by properly controlling the pressure in the control chamber 4 while utilizing suction pressure Ps in the suction chamber 3 for sucking fluid, discharge pressure Pd in the discharge chamber 2 for discharging fluid pressurized by the pistons 7, and control pressure Pc in the control chamber 4 housing the swash plate 6, continuously changing the inclination angle of the swash plate 6, and thereby changing the stroke volume of the pistons 7. For the sake of explanatory convenience, FIG. 1 does not show the displacement control valve V incorporated in the variable displacement compressor M.

Specifically, the higher the control pressure Pc in the control chamber 4, the smaller the inclination angle of the swash plate 6 with respect to the rotating shaft 5, and the stroke volume of the pistons 7 is reduced. Under pressure above a certain level, the swash plate 6 is in a substantially vertical position with respect to the rotating shaft 5 (a position slightly inclined from a vertical position). At this time, the pistons 7 have a minimum stroke volume, and the pistons 7 apply a minimum pressure to fluid in the cylinders 4*a*, so that the discharge rate of the fluid into the discharge chamber 2 is reduced, and the air-conditioning system has a minimum cooling capacity. On the other hand, the lower the control pressure Pc in the control chamber 4, the larger the inclination angle of the swash plate 6 with respect to the rotating shaft 5, and the stroke volume of the pistons 7 is increased. Under pressure below a certain level, the swash plate 6 is at a maximum inclination angle with respect to the rotating shaft 5. At this time, the pistons 7 have a maximum stroke volume, and the pistons 7 apply a maximum pressure to fluid in the cylinders 4*a*, so that the discharge rate of the fluid into the discharge chamber 2 is increased, and the air-conditioning system has a maximum cooling capacity.

As shown in FIG. 2, the displacement control valve V incorporated in the variable displacement compressor M variably controls the control pressure Pc in the control chamber 4 by adjusting current passed through a coil 86 constituting a part of a solenoid 80, performing opening and closing control of a main valve 50 and a secondary valve 54 in the displacement control valve V, performing opening and closing control of a pressure-sensitive valve 53 according to ambient fluid pressure, and controlling fluid flowing into the control chamber 4 or flowing out of the control chamber 4.

In the present embodiment, the main valve 50 consists of a main-secondary valve element 51 serving as a valve element, and a main valve seat 10*a* formed at an annular protrusion 10*c* of an isosceles trapezoidal shape in a cross-sectional view protruding from an inner peripheral surface of a valve housing 10 to the inside-diameter side. The axially left end 51*a* of the main-secondary valve element 51 contacts and separates from the main valve seat 10*a*. The secondary valve 54 consists of the main-secondary valve element 51 and a secondary valve seat 82*a* formed at an opening end face (an axially left end face) of a fixed core 82. A step 51*b* of the main-secondary valve element 51 on the axially right side contacts and separates from the secondary valve seat 82*a*. The pressure-sensitive valve 53 consists of an adapter 70 of a pressure-sensitive element 60 and a pressure-sensitive valve seat 52*a* formed at the axially left end of a pressure-sensitive valve member 52. The axially right end 70*a* of the adapter 70 contacts and separates from the pressure-sensitive valve seat 52*a*.

Next, the structure of the displacement control valve V will be described. As shown in FIG. 2, the displacement control valve V consists mainly of the valve housing 10 formed of a metal material or a resin material, the main-secondary valve element 51 and the pressure-sensitive valve member 52 disposed axially reciprocatably in the valve housing 10, the pressure-sensitive element 60 that applies axially rightward biasing force to the main-secondary valve element 51 and the pressure-sensitive valve member 52 according to ambient fluid pressure, the solenoid 80 that is connected to the valve housing 10 and exerts driving force on the main-secondary valve element 51 and the pressure-sensitive valve member 52, and a sliding member 90 provided axially reciprocatably relatively to the pressure-sensitive valve member 52 by fluid flow produced by the opening of the main valve 50. The sliding member 90 opens and closes a flow path between a secondary valve chest 30 under the suction pressure Ps and a pressure-sensitive chamber 40 under the control pressure Pc by its reciprocation, and thus can be said to constitute a CS valve together with the pressure-sensitive valve member 52.

As shown in FIG. 2, the solenoid 80 consists mainly of a casing 81 having an opening 81*a* opening axially leftward, the fixed core 82 of a substantially cylindrical shape that is inserted axially from the left into the opening 81*a* of the casing 81, and is fixed to the inside-diameter side of the casing 81, a drive rod 83 that can axially reciprocate on the inside-diameter side of the fixed core 82, and is connected and fixed at an axially left end portion thereof to the main-secondary valve element 51, a movable core 84 fixed to an axially right end portion of the drive rod 83, a coil spring 85 that is provided between the fixed core 82 and the movable core 84, and biases the movable core 84 axially rightward, and the exciting coil 86 wound on the outside of the fixed core 82 via a bobbin.

The casing 81 is formed with a recess 81*b* recessed axially rightward from the radial center of the axially left end. In the recess 81*b*, an axially right end portion of the valve housing 10 is inserted and fixed.

The fixed core 82 is formed from a rigid body of a magnetic material such as iron or silicon steel, and includes an axially extending cylindrical portion 82*b* formed with an insertion hole 82*c* into which the drive rod 83 is inserted, and an annular flange 82*d* extending in the outside-diameter direction from an outer peripheral surface of an axially left end portion of the cylindrical portion 82*b*, and is formed with a recess 82*e* recessed axially rightward from the radial center of the axially left end of the cylindrical portion 82*b*.

As shown in FIG. 2, the valve housing 10 is of a bottomed substantially cylindrical shape by a partition adjustment member 11 being press-fitted into an axially left end portion thereof. In the valve housing 10, the main-secondary valve element 51 and the pressure-sensitive valve member 52 are axially reciprocatably disposed. A portion of the inner peripheral surface of the valve housing 10 is formed with a small-diameter guide surface 10*b* on which the outer peripheral surface of the main-secondary valve element 51 can slide. The partition adjustment member 11 can adjust the biasing force of the pressure-sensitive element 60 by adjusting the axial placement position in the valve housing 10.

In the valve housing 10, a main valve chest 20 in which the axially left end 51*a* side of the main-secondary valve element 51 is disposed, a secondary valve chest 30 formed on the back-pressure side (the axially right side) of the main-secondary valve element 51, and the pressure-sensitive chamber 40 formed in a position opposite to the secondary valve chest 30 relative to the main valve chest 20 are formed. The secondary valve chest 30 is demarcated by the outer peripheral surface of the main-secondary valve element 51 on the back-pressure side, the opening end face (the axially left end face) and the recess 82*e* of the fixed core 82, and the inner peripheral surface of the valve housing 10 on the axially right side of the guide surface 10*b*.

In the valve housing 10, Pd ports 12 serving as discharge ports for connecting the main valve chest 20 and the discharge chamber 2 of the variable displacement compressor M, Ps ports 13 serving as suction ports for connecting the secondary valve chest 30 and the suction chamber 3 of the variable displacement compressor M, and Pc ports 14 serving as control ports for connecting the pressure-sensitive chamber 40 and the control chamber 4 of the variable displacement compressor M are formed.

As shown in FIG. 2, the pressure-sensitive element 60 consists mainly of a bellows core 61 having the coil spring 62 built-in, and the adapter 70 formed at an axially right end portion of the bellows core 61. The axially left end of the bellows core 61 is fixed to the partition adjustment member 11.

The pressure-sensitive element 60 is disposed in the pressure-sensitive chamber 40, and operates to provide a resultant force of a biasing force to move the adapter 70 axially rightward and an axially rightward biasing force on the main-secondary valve element 51 and the pressure-sensitive valve member 52 according to the suction pressure Ps in the secondary valve chest 30, which serves as ambient fluid pressure, thereby causing the axially right end 70*a* of the adapter 70 to be seated on the pressure-sensitive valve seat 52*a* of the pressure-sensitive valve member 52. When the suction pressure Ps in an intermediate communicating passage 55 is high, the pressure-sensitive element 60 contracts under ambient fluid pressure, operating to separate the axially right end 70*a* of the adapter 70 from the pressure-sensitive valve seat 52*a* of the pressure-sensitive valve member 52, and thereby opening the pressure-sensitive valve 53, which is not shown for the sake of explanatory convenience. Thus, when the suction pressure Ps in the secondary valve chest 30 is high, for example, the control pressure Pc can be quickly released through the intermediate communicating passage 55 and a plurality of through holes 51*c* in the main-secondary valve element 51 into the secondary valve chest 30.

As shown in FIG. 2, the main-secondary valve element 51 is formed in a substantially cylindrical shape. To an axially left end portion thereof, the pressure-sensitive valve member 52 of a different body is connected and fixed, and to an axially right end portion thereof, the drive rod 83 is connected and fixed. They move axially in an integrated manner. In the main-secondary valve element 51 and the pressure-sensitive valve member 52, the intermediate communicating passage 55 extending axially through them is formed by hollow holes being connected. The intermediate communicating passage 55 communicates with the secondary valve chest 30 through the plurality of through holes 51*c* radially extending at an axially right end portion of the main-secondary valve element 51.

Figure 3:
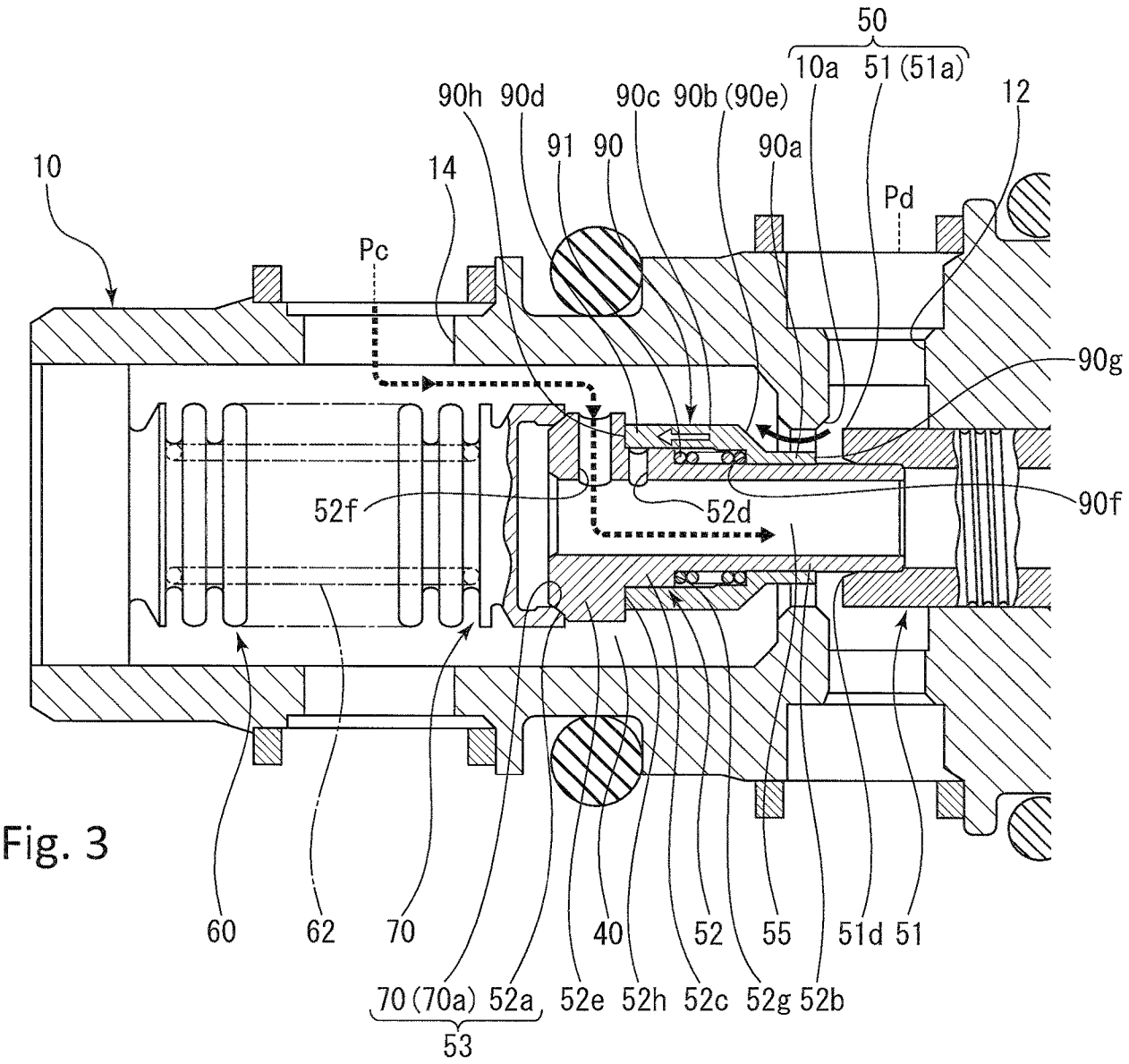
FIG. 3 is an enlarged cross-sectional view of FIG. 2 showing the displacement control valve in the first embodiment in the non-energized state in which the main valve is opened, and the through holes in the pressure-sensitive valve member are closed by the sliding member.
Figure 4:
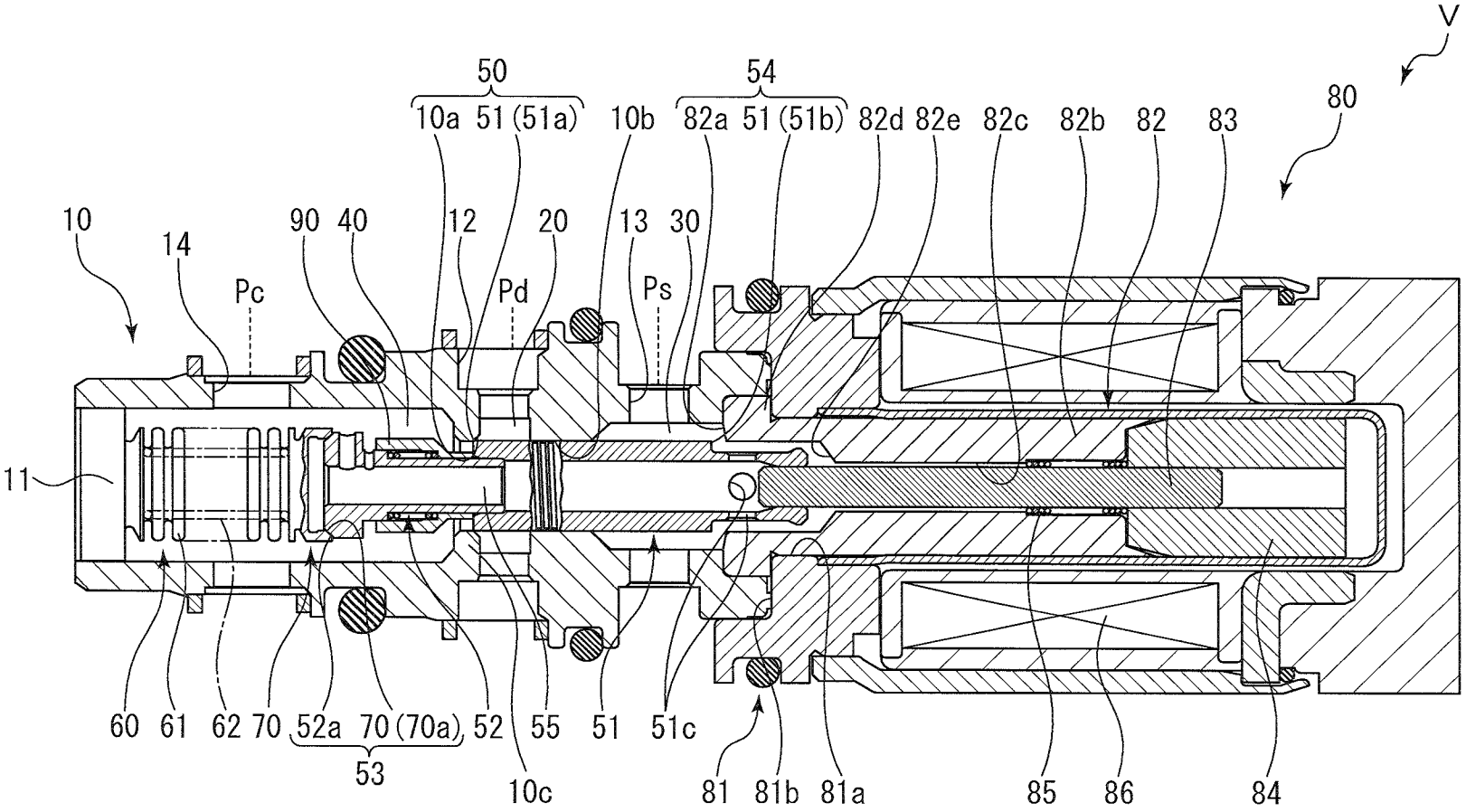
FIG. 4 is a cross-sectional view showing the displacement control valve in the first embodiment in an energized state in which the main valve is closed, and the through holes in the pressure-sensitive valve member are opened by the movement of the sliding member.
Figure 5:
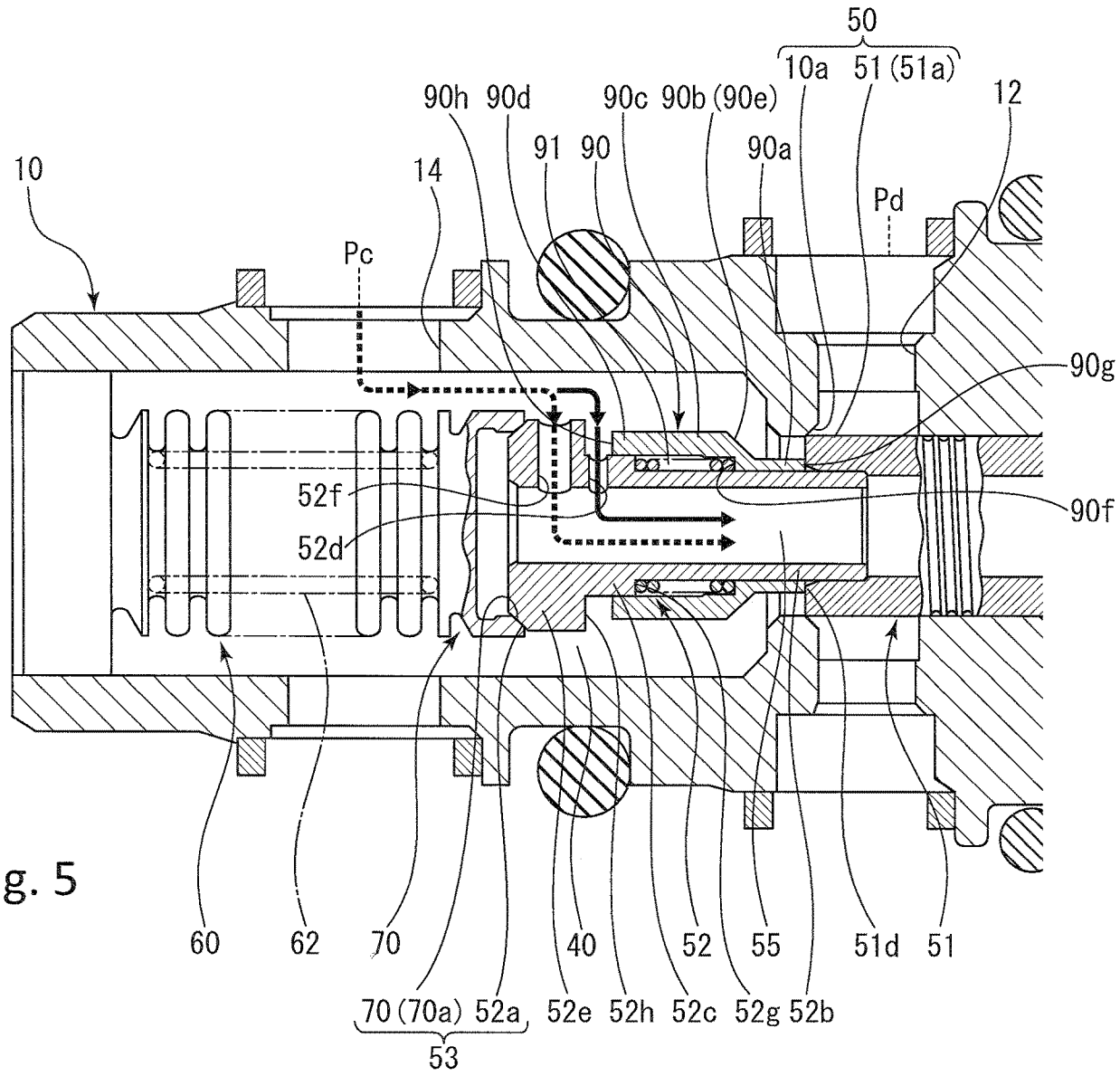
FIG. 5 is an enlarged cross-sectional view of FIG. 4 showing the displacement control valve in the first embodiment in the energized state in which the main valve is closed, and the through holes in the pressure-sensitive valve member are opened by the movement of the sliding member.

As shown in FIGS. 3 and 5, the pressure-sensitive valve member 52 is formed in a stepped cylindrical shape and substantially a battery shape in a side view having a small-diameter mounting portion 52*b* connected and fixed to the main-secondary valve element 51, with a coil spring 91 serving as a biasing member externally fitted thereon, a sliding contact portion 52*c* that is formed with a larger diameter than the mounting portion 52*b* on the axially left side of the mounting portion 52*b*, and is provided with a plurality of circumferentially evenly spaced through holes 52*d* that is opened and closed by an opening/closing end portion 90*d* of the sliding member 90 described later, and communicates with the intermediate communicating passage 55, and an abutting portion 52*e* that is formed with a larger diameter than the sliding contact portion 52*c* on the axially left side of the sliding contact portion 52*c*, and is formed with the pressure-sensitive valve seat 52*a* that contacts and separates from the axially right end 70*a* of the adapter 70. The abutting portion 52*e* is provided with an auxiliary communicating hole 52*f* that extends radially therethrough and connects the pressure-sensitive chamber 40 and the intermediate communicating passage 55. The auxiliary communicating hole 52*f* forms a Pc-Ps communicating passage (shown by dotted-line arrows in FIGS. 3 and 5), thereby functioning as a fixed orifice for adjusting the pressure balance between the suction chamber 3 and the control chamber 4. Accordingly, the control pressure Pc in the pressure-sensitive chamber 40 flows into the intermediate communicating passage 55. Therefore, the flow path cross-sectional area of the auxiliary communicating hole 52*f* is preferably set such that the intermediate communicating passage 55 is under the generally suction pressure Ps. In addition, the auxiliary communicating hole 52*f* does not necessarily need to be provided.

The axially left end of the coil spring 91 abuts a side surface 52*g* of the mounting portion 52*b* extending in the outside-diameter direction from the axially left end, and the axially right end of the coil spring 91 abuts an inner surface (an annular surface 90*f* described later) of the sliding member 90 externally fitted on the mounting portion 52*b* and the sliding contact portion 52*c* of the pressure-sensitive valve member 52, biasing the sliding member 90 to the axially right side (the main valve 50 side). The coil spring 91 is a compression spring, and its outer periphery is radially at a slight distance from the inner peripheral surface of the sliding member 90. Furthermore, the outer periphery of the coil spring 91 may be guided by the inner peripheral surface of the sliding member 90, and the inner periphery of the coil spring 91 may be radially at a slight distance from the outer peripheral surface of the pressure-sensitive valve member 52 (the mounting portion 52*b*).

As shown in FIGS. 3 and 5, the sliding member 90 has the outside formed in a stepped cylindrical shape having a small-diameter first cylindrical portion 90*a* externally fitted on the mounting portion 52*b* of the pressure-sensitive valve member 52, a tapered portion 90*b* extending from the axially left end of the first cylindrical portion 90*a* to the axially left side, expanding in diameter, and a second cylindrical portion 90*c* that is formed with a larger diameter than the first cylindrical portion 90*a* on the axially left side of the tapered portion 90*b*, and is formed with the opening/closing end portion 90*d* for opening and closing the through holes 52*d* in the pressure-sensitive valve member 52 on the axially left end side opposite to the main valve 50. The outer periphery of the tapered portion 90*b* of the sliding member 90 constitutes a receiving surface 90*e* that faces axially rightward (toward the main valve 50), and is inclined with respect to the reciprocating direction of the main-secondary valve element 51 and the sliding member 90. Although the receiving surface 90*e* has been described with a linear inclination in a side view as an example, the receiving surface 90*e* may be of another shape such as a curved shape in a side view.

The sliding member 90 has the inside formed in a stepped cylindrical shape in which the inside diameter of the second cylindrical portion 90*c* is larger than that of the first cylindrical portion 90*a*, and formed with the annular surface 90*f* that extends in the outside-diameter direction from the axially left end of the inner peripheral surface of the first cylindrical portion 90*a* and intersects at right angles to be continuous in an axial position corresponding to substantially the axial center of the tapered portion 90*b* (the receiving surface 90*e*). That is, the annular surface 90*f* is formed on the back side (the inner peripheral side) of the receiving surface 90*e*. Note that the inner peripheral surface of the first cylindrical portion 90*a* and the outer peripheral surface of the mounting portion 52*b* of the pressure-sensitive valve member 52, and the inner peripheral surface of the second cylindrical portion 90*c* and the outer peripheral surface of the sliding contact portion 52*c* of the pressure-sensitive valve member 52 are arranged radially at a slight distance from each other, thereby forming a minute gap between them. Thus, the sliding member 90 can relatively move axially smoothly to the pressure-sensitive valve member 52.

The sliding member 90 is formed, at the axially right end thereof, that is, the axially right end of the first cylindrical portion 90*a*, with an end face portion 90*g* that abuts a stopper 51*d* at an axially left end face of the main-secondary valve element 51 when the through holes 52*d* in the pressure-sensitive valve member 52 are opened by the opening/closing end portion 90*d* (see FIGS. 4 and 5), and is formed, at the axially left end thereof, that is, the axially left end of the second cylindrical portion 90*c*, with an end face 90*h* that can abut a side surface 52*h* of the sliding contact portion 52*c* of the pressure-sensitive valve member 52 extending in the outside-diameter direction from the axially left end when the through holes 52*d* in the pressure-sensitive valve member 52 are closed by the opening/closing end portion 90*d* (see FIGS. 2 and 3). Thus, the axial position of the sliding member 90 at the time of opening and at the time of closing of the through holes 52*d* in the pressure-sensitive valve member 52 by the opening/closing end portion 90*d* is determined.

Note that the through holes 52*d* in the pressure-sensitive valve member 52 are formed on the axially right side of the axially left end (the side surface 52*h*) of the sliding contact portion 52*c*. Thus, until the end face 90*h* at the axially left end of the sliding member 90 (the opening/closing end portion 90*d*) has moved from the state of abutting the side surface 52*h* of the pressure-sensitive valve member 52 to the axial position of the axially left-side opening edge of the through holes 52*d*, the opening/closing end portion 90*d* is radially placed on the through holes 52*d*, maintaining the through holes 52*d* closed.

Next, operation, mainly the operation of an opening/closing mechanism for the through holes 52*d* in the pressure-sensitive valve member 52 by the sliding member 90 at the time of startup and during normal control will be described in this order.

First, the operation at the time of startup will be described. After the variable displacement compressor M has been left unused for a long time, the discharge pressure Pd, the control pressure Pc, and the suction pressure Ps are substantially in equilibrium. In the displacement control valve V in a non-energized state, the movable core 84 is pressed axially rightward by the biasing force of the coil spring 85 constituting a part of the solenoid 80, so that the drive rod 83, the main-secondary valve element 51, and the pressure-sensitive valve member 52 move axially rightward, the step 51*b* of the main-secondary valve element 51 on the axially right side is seated on the secondary valve seat 82*a* of the fixed core 82, closing the secondary valve 54, and the axially left end 51*a* of the main-secondary valve element 51 is separated from the main valve seat 10*a* formed at the inner peripheral surface of the valve housing 10, opening the main valve 50. At this time, the sliding member 90 is located axially rightward, opening the through holes 52*d* in the pressure-sensitive valve member 52.

By starting the variable displacement compressor M and bringing the displacement control valve V into an energized state, the main valve 50 is closed and the secondary valve 54 is opened. As shown in FIG. 5, the sliding member 90 is located axially rightward, so that a flow path for discharging fluid from the control chamber 4 through the pressure-sensitive chamber 40 (the Pc ports 14), the through holes 52*d*, the intermediate communicating passage 55, and the secondary valve chest 30 (the Ps ports 13) into the suction chamber 3 is formed. Liquefied fluid in the control chamber 4 can be discharged in a short time to enhance responsivity at the time of startup. Thus, when the sliding member 90 opens the through holes 52*d*, the pressure-sensitive chamber 40 communicates with the intermediate communicating passage 55 through the through holes 52*d* and the auxiliary communicating hole 52*f*, allowing fluid flow (shown by solid-line arrows and dotted-line arrows in FIG. 5).

Next, the operation during the normal control will be described. During the normal control, under duty control by the displacement control valve V, the degree of opening and the opening time of the main valve 50 are adjusted to control the flow rate of fluid from the Pd ports 12 to the Pc ports 14. At this time, the sliding member 90 receives at the receiving surface 90*e* the flow of fluid from the Pd ports 12 to the Pc ports 14 produced by the opening of the main valve 50 (shown by a solid-line arrow in FIG. 3), so that a force to move the sliding member 90 axially leftward (shown by a white arrow in FIG. 3) acts on the sliding member 90. The sliding member 90 moves axially leftward against the biasing force of the coil spring 91, closing the through holes 52*d* in the pressure-sensitive valve member 52 by the opening/closing end portion 90*d* (see FIG. 3). Since the through holes 52*d* are closed during the normal control in this manner, a flow path from the control chamber 4 through the pressure-sensitive chamber 40 (the Pc ports 14), the through holes 52*d*, the intermediate communicating passage 55, and the secondary valve chest 30 (the Ps ports 13) into the suction chamber 3 is not formed, which thus reduces the refrigerant flow from the control chamber 4 into the suction chamber 3, and can enhance the operational efficiency of the variable displacement compressor M.

When the variable displacement compressor M is driven at a maximum capacity, by bringing the displacement control valve V into a maximum-duty energized state, the main valve 50 is closed, and the sliding member 90 is moved axially rightward to open the through holes 52*d* in the pressure-sensitive valve member 52 to allow communication between the control chamber 4 (the Pc ports 14) and the suction chamber 3 (the Ps ports 13). Thus, the control pressure Pc can be quickly reduced. This enables the pistons 7 in the cylinders 4*a* in the control chamber 4 to vary rapidly, thereby enhancing operational efficiency while maintaining the maximum capacity state.

Under duty control by the displacement control valve V, the degree of opening and the opening time of the main valve 50 are adjusted to control the flow rate of fluid from the Pd ports 12 to the Pc ports 14, and the axially leftward movement of the sliding member 90 is then adjusted, so that the degree of opening of the through holes 52*d* in the pressure-sensitive valve member 52 can be adjusted by the opening/closing end portion 90*d* of the sliding member 90. Thus, the flow rate of fluid from the control chamber 4 (the Pc ports 14) to the suction chamber 3 (the Ps ports 13) can be controlled.

In the displacement control valve V in the non-energized state, the receiving surface 90*e* of the sliding member 90, which faces axially rightward (toward the main valve 50), thus receives the flow of fluid from the Pd ports 12 to the Pc ports 14 produced by the opening of the main valve 50, causing a force to move the sliding member 90 axially leftward to easily act on the sliding member 90. The sliding member 90 thus operates easily.

In the displacement control valve V in the non-energized state, the receiving surface 90*e* of the sliding member 90, which is inclined with respect to the reciprocating direction of the main-secondary valve element 51 and the sliding member 90, thus facilitates the production of fluid flow from the Pd ports 12 to the Pc ports 14 by the opening of the main valve 50.

In the valve housing 10, the sliding member 90 has the outer peripheral surface of the first cylindrical portion 90*a* and the tapered portion 90*b* disposed along and in proximity to the inner peripheral surface of the annular protrusion 10*c* at which the main valve seat 10*a* constituting a part of the main valve 50 is formed, thus forming a relatively narrow flow path between the main valve chest 20 and the pressure-sensitive chamber 40. Consequently, by the opening of the main valve 50, fluid flow from the Pd ports 12 to the Pc ports 14 is produced more easily.

Since the coil spring 91 for biasing the sliding member 90 axially rightward (toward the main valve 50) is disposed on the back side (the inner peripheral side) of the receiving surface 90*e* of the sliding member 90, the sliding member 90 can be axially reciprocated by a simple structure.

Since the sliding member 90 can maintain the through holes 52*d* in the pressure-sensitive valve member 52 closed by the opening/closing end portion 90*d* until the sliding member 90 has slid axially rightward a predetermined distance or more from the state where the end face 90*h* abuts the side surface 52*h* of the pressure-sensitive valve member 52, even when the sliding member 90 is slightly slid by disturbance such as vibration, the through holes 52*d* in the pressure-sensitive valve member 52 can be maintained closed. Therefore, the displacement control valve V is resistant to disturbance, and excellent in control accuracy.

Since the main-secondary valve element 51 and the pressure-sensitive valve member 52 are different bodies, and the main-secondary valve element 51 is formed with the stopper 51*d* for restricting the axially rightward movement of the sliding member 90, the axial movement of the sliding member 90 can be restricted by a simple structure.

The plurality of through holes 52*d* is formed in the pressure-sensitive valve member 52, and thus can provide a large flow path cross-sectional area for discharging fluid from the control chamber 4 (the Pc ports 14) into the suction chamber 3 (the Ps ports 13). Since the through holes 52*d* are spaced circumferentially evenly, the stroke of the sliding member 90 can be shortened.

Second Embodiment

Next, a displacement control valve according to a second embodiment will be described with reference to FIG. 6. The same reference numerals and letters are assigned to the same components as those shown in the above-described embodiment without duplicated explanations.

A displacement control valve V in the second embodiment will be described. As shown in FIG. 6, in the present embodiment, a pressure-sensitive valve member 152 is formed in a stepped cylindrical shape and substantially a battery shape in a side view having a small-diameter mounting portion 152*b* connected and fixed to a main-secondary valve element 51, with a coil spring 91 externally fitted thereon, a sliding contact portion 152*c* that is formed with a larger diameter than the mounting portion 152*b* on the axially left side of the mounting portion 152*b*, and is provided with a plurality of through holes 152*d* that is opened and closed by an opening/closing end portion 190*d* of a sliding member 190, and communicates with an intermediate communicating passage 55, and an abutting portion 152*e* that is formed with a larger diameter than the sliding contact portion 152*c* on the axially left side of the sliding contact portion 152*c*, and is formed with a pressure-sensitive valve seat 152*a* that contacts and separates from the axially right end 70*a* of an adapter 70.

Figure 6:
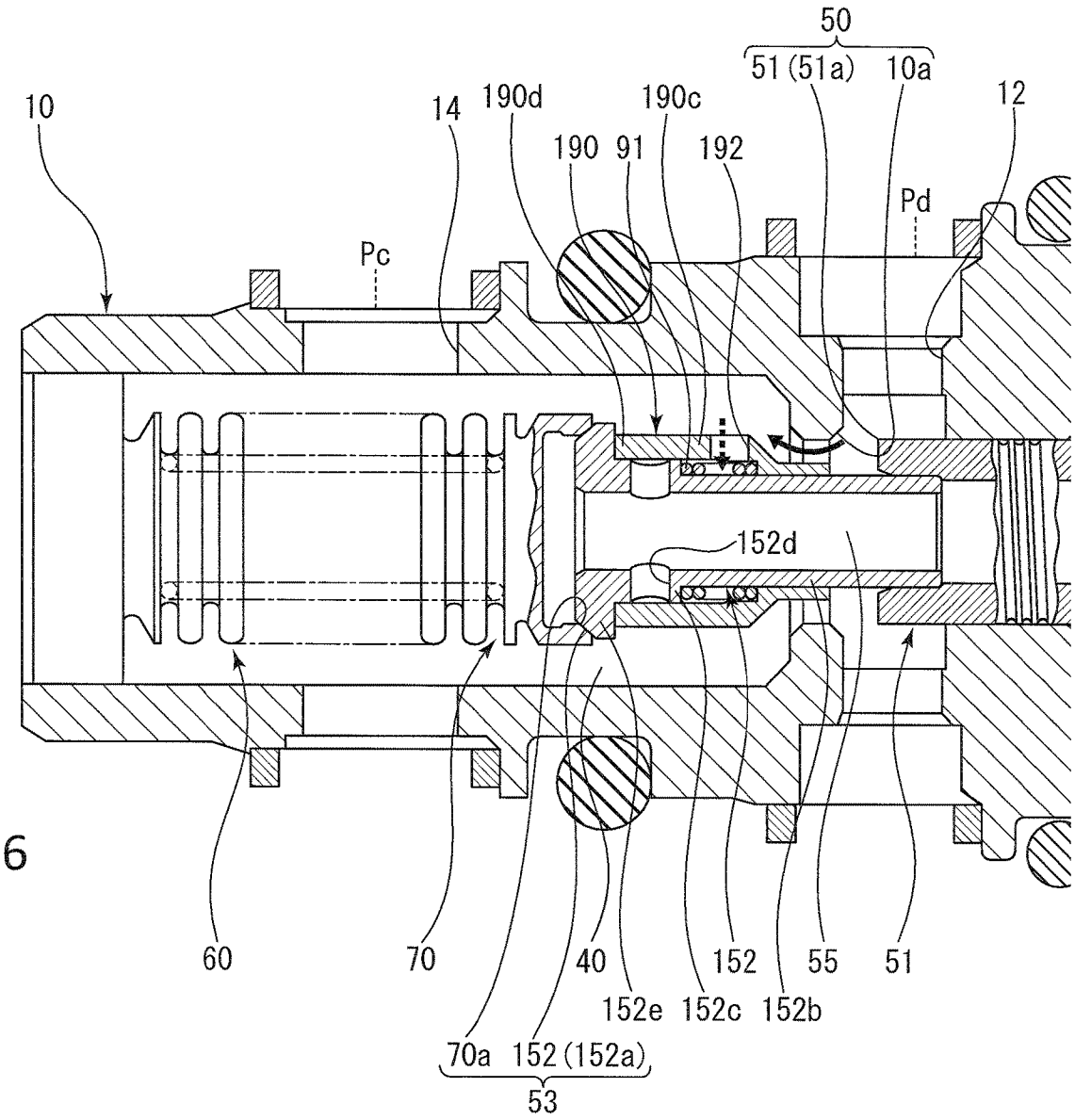
FIG. 6 is an enlarged cross-sectional view showing a displacement control valve according to a second embodiment of the present invention in a non-energized state in which a main valve is opened, and through holes in a pressure-sensitive valve member are closed by a sliding member.

As shown in FIG. 6, the sliding member 190 is provided with a vent hole 192 extending radially therethrough in an axially right end portion of a second cylindrical portion 190*c*, specifically, in a position on the axially right side (the main valve 50 side) of the opening/closing end portion 190*d* for opening and closing the through holes 152*d* in the pressure-sensitive valve member 152. The vent hole 192 allows communication between a space formed between the sliding member 190 and the pressure-sensitive valve member 152, in which space the coil spring 91 is disposed, and a pressure-sensitive chamber 40.

This causes fluid in the space formed between the sliding member 190 and the pressure-sensitive valve member 152 to flow into and out of the pressure-sensitive chamber 40 through the vent hole 192 with the reciprocation of the sliding member 190 (shown by a dotted-line arrow in FIG. 6), and thus is less prone to develop a pressure difference between the interior of the space and the pressure-sensitive chamber 40, reducing the effect (force toward the valve-closing direction) of the pressure difference on the sliding member 190 and thus allowing the sliding member 190 to reciprocate smoothly.

Although the embodiments of the present invention have been described above with reference to the drawings, a specific configuration thereof is not limited to the embodiments. Any changes and additions made to them without departing from the scope of the present invention are included in the present invention.

For example, the embodiments have described the sliding member as one that axially reciprocates relatively to the pressure-sensitive valve member. The sliding member is not limited to this, and may be one that axially reciprocates relatively to the pressure-sensitive valve member while rotationally sliding thereon.

The example where the main-secondary valve element 51 and the pressure-sensitive valve member 52 are formed in different bodies has been described. Alternatively, the two may be formed in a body.

The receiving surface of the sliding member may be formed to be at right angles to the reciprocating direction of the main-secondary valve element 51 and the sliding member.

The sliding member may be reciprocably guided by the adapter 70.

The communicating passage directly connecting the control chamber 4 and the suction chamber 3 of the variable displacement compressor M and the fixed orifice do not necessarily need to be provided.

In the above embodiments, the secondary valve does not necessarily need to be provided. The step on the axially right side of the main-secondary valve element only needs to function as a support member for receiving axial load, and does not necessarily need to have a sealing function.

The secondary valve chest 30 may be provided axially opposite the solenoid 80, and the pressure-sensitive chamber 40 may be provided on the solenoid 80 side.

The coil spring 91 is not limited to a compression spring, and may be a tension spring, or may be of a shape other than a coil shape.

The pressure-sensitive element 60 may not have the coil spring inside.

In the first embodiment, the vent hole 192 in the second embodiment may be provided.

REFERENCE SIGNS LIST

1 casing
2 discharge chamber
3 suction chamber
4 control chamber
10 valve housing
10*a* main valve seat
10*c* annular protrusion
11 partition adjustment member
12 Pd port (discharge port)
13 Ps port (suction port)
14 Pc port (control port)
20 main valve chest
30 secondary valve chest
40 pressure-sensitive chamber

50 main valve
51 main-secondary valve element (valve element)
51*c* through hole
51*d* stopper
52 pressure-sensitive valve member
52*a* pressure-sensitive valve seat
52*b* *mounting portion*
52*c* *sliding contact portion*
52*d* through hole
52*e* abutting portion
52*f* auxiliary communicating hole
52*g*, 52*h* side surface
53 pressure-sensitive valve
54 secondary valve
55 intermediate communicating passage
60 pressure-sensitive element
61 bellows core
62 coil spring
70 adapter
80 solenoid
82 fixed core
82*a* secondary valve seat
90 sliding member
90*a* first cylindrical portion
90*b* tapered portion
90*c* second cylindrical portion
90*d* opening/closing end portion
90*e* receiving surface
90*f* annular surface
90*g*, 90*h* end face
91 coil spring (biasing member)
152 pressure-sensitive valve member
190 sliding member
192 vent hole
Pc control pressure
Pd discharge pressure
Ps suction pressure
V displacement control valve

The invention claimed is:

1. A displacement control valve comprising:

a valve housing formed with a discharge port, a suction port, and a control port;

a valve element formed in a cylindrical shape and constituting a main valve that contacts and separates from a main valve seat, for opening and closing communication between the discharge port and the control port by driving force of a solenoid;

a bellows core housed in a control pressure chamber which is formed inside of the valve housing and which always communicates with the control port, the bellows core having a first end portion fixed to the valve housing and a second end portion opposed to the first end portion in an axial direction of the bellows core;

valve member formed in a cylindrical shape and extending from the valve element to a control pressure chamber, the valve member being configured for contacting and separating from an adapter; and a sliding member outwardly inserted to the valve member and slidable toward a side of the bellows core with respect to the valve member by fluid flowing from the discharge port to the control port upon opening of the main valve, the valve element and the valve member having an intermediate communicating passage formed therein, the intermediate communicating passage allowing communication between the control port and the suction port when the valve member separates from the adapter wherein the valve member is formed with a through hole communicating the control pressure chamber with the intermediate communicating passage, and the through hole is opened and closed in accordance with a sliding movement of the sliding member with respect to the valve member.

2. The displacement control valve according to claim 1, wherein the sliding member is formed with a receiving surface facing toward the main valve and receiving the fluid flowing from the discharge port to the control port upon opening of the main valve.

3. The displacement control valve according to claim 2, wherein the receiving surface is inclined with respect to a reciprocating direction of the valve element.

4. The displacement control valve according to claim 2, wherein on a back side of the receiving surface, a coil spring for biasing the sliding member toward the main valve is disposed.

5. The displacement control valve according to claim 1, wherein the sliding member is formed with a vent hole on a side of the main valve with respect to the through hole of the valve member.

6. The displacement control valve according to claim 1, wherein the sliding member is disposed so that the sliding member can move while closing the through hole.

7. The displacement control valve according to claim 1, wherein the valve element and the valve member are different bodies, and the valve element is formed with a stopper for restricting movement of the sliding member toward the valve element.

8. The displacement control valve according to claim 1, wherein the through hole is one of a plurality of through holes formed in the valve member.

9. The displacement control valve according to claim 3, wherein on a back side of the receiving surface, a coil spring for biasing the sliding member toward the main valve is disposed.

10. The displacement control valve according to claim 2, wherein the sliding member is formed with a vent hole on a side of the main valve with respect to the through hole of the valve member.

11. The displacement control valve according to claim 2, wherein the sliding member is disposed so that the sliding member can move while closing the through hole.

12. The displacement control valve according to claim 2, wherein the valve element and the valve member are different bodies, and the valve element is formed with a stopper for restricting movement of the sliding member toward the valve element.

13. The displacement control valve according to claim 2, wherein the through hole is one of a plurality of through holes formed in the valve member.

14. The displacement control valve according to claim 3, wherein the sliding member is formed with a vent hole on a side of the main valve with respect to the through hole of the valve member.

15. The displacement control valve according to claim 3, wherein the sliding member is disposed so that the sliding member can move while closing the through hole.

16. The displacement control valve according to claim 3, wherein the valve element and the valve member are different bodies, and the valve element is formed with a stopper for restricting movement of the sliding member toward the valve element.

17. The displacement control valve according to claim 3, wherein the through hole is one of a plurality of through holes formed in the valve member.

* * * * *